US006660103B1

(12) United States Patent
Johnston et al.

(10) Patent No.: US 6,660,103 B1
(45) Date of Patent: Dec. 9, 2003

(54) CLEANING PROCESS FOR INK JET PRINTHEADS

(75) Inventors: Ian Johnston, Las Vegas, NV (US); Greg Sinchar, Henderson, NV (US)

(73) Assignee: VUTEk, Inc., Meredith, NH (US)

( * ) Notice: Subject to any disclaimer, the term of this patent is extended or adjusted under 35 U.S.C. 154(b) by 44 days.

(21) Appl. No.: 10/112,092

(22) Filed: Mar. 28, 2002

(51) Int. Cl.[7] ..... B08B 3/00

(52) U.S. Cl. ..... 134/30; 134/2; 134/22.1; 134/22.12; 134/22.14; 134/22.18; 134/26; 134/31; 134/36; 134/37; 134/42

(58) Field of Search ..... 134/2, 22.1, 22.12, 134/22.14, 26, 30, 31, 36, 37, 42, 22.18

(56) References Cited

U.S. PATENT DOCUMENTS

| | | | | |
|---|---|---|---|---|
| 4,829,318 | A | 5/1989 | Racicot et al. | 346/1.1 |
| 4,853,717 | A | 8/1989 | Harmon et al. | 346/140 |
| 5,917,512 | A | 6/1999 | Weber et al. | 347/28 |
| 5,923,347 | A | 7/1999 | Wade | 347/28 |
| 6,039,431 | A | 3/2000 | Yui et al. | 347/30 |
| 6,158,839 | A | 12/2000 | Fukushima et al. | 347/33 |
| 6,183,059 | B1 | 2/2001 | Muhl et al. | 347/33 |
| 6,193,352 | B1 | 2/2001 | Sharma et al. | 347/28 |
| 6,196,657 | B1 | 3/2001 | Hawkins et al. | 347/28 |
| 6,254,216 | B1 | 7/2001 | Arway et al. | 347/28 |
| 6,273,103 | B1 | 8/2001 | Enz et al. | 134/22.11 |
| 6,281,909 | B1 | 8/2001 | Fassler et al. | 347/28 |
| 6,286,929 | B1 | 9/2001 | Sharma et al. | 347/27 |
| 2003/0117472 | A1 * | 6/2003 | Pearlstine et al. | 347/97 |

OTHER PUBLICATIONS

Nova JA–256/80 LQ Performance Specifications, Rev. 02.

* cited by examiner

*Primary Examiner*—Sharidan Carrillo
(74) *Attorney, Agent, or Firm*—Hamilton, Brook, Smith & Reynolds, P.C.

(57) ABSTRACT

A method of cleaning ink jet printheads without rendering the printheads inoperative by soaking the printheads in a cleaning solution of acetone and n-methyl-2-pyrolidine, and then flushing the printhead with a gas, such as air. The solution is made of about 70% acetone and about 30% n-methyl-2-pyrolidine by weight.

30 Claims, 11 Drawing Sheets

CLEANING PROCESS FOR INK JET PRINTHEADS

BACKGROUND

Certain printing systems use drop on demand ink jet printheads. These printheads deposit ink through one or more nozzles onto a substrate to create a desired image. For example, in some large-scale applications, ink jet printing systems have been used to print images on substrates, such as banners, museum displays, billboards, sails, and bus boards.

Typically, the ink used in these printing systems are made of a dye or pigment to create the various colors of the image, and a carrier liquid, such as water or some other suitable solvent. In addition, the ink contains a polymer that acts as a glue which fuses to a harden state to keep the pigment in place after the ink has been deposited onto the substrate.

However, over time, the ink accumulates in the nozzles, as well as around the orifices of the nozzle plates, and in the various channels of the printhead which convey the ink through the printhead to the nozzles.

Conventional techniques to clean the printheads include removing the printhead from the printing system, forcing a solvent such as glycol ether DPM acetate through the printhead, and then purging the printhead with high pressure air to blow out the debris from the channels and nozzles.

However, forcing glycol ether DPM acetate through the printhead has certain drawbacks. When glycol ether DPM acetate is streamed into the head, the fluid simply takes the easiest route through the printhead, thereby avoiding any blocked channels. The printheads are typically held together by an epoxy that can break apart if a chemical that is too aggressive is introduced, or if a pressure that is too high is used to force solvents or air through the printhead.

Glycol ether DPM acetate is commonly used in cleaning operations of printheads, which is not a very aggressive chemical. As such, glycol ether DPM acetate does not properly re-dissolve polymer that has been throughly dried. Furthermore, glycol ether DPM acetate tends to simply break the very dry polymer into chunks which can then flow into the smaller channels of the printheads, thereby exacerbating the problem. Thus, the use of glycol ether DPM acetate is typically effective if the printheads are still wet with ink or if used immediately after blockage is detected.

The present invention implements a method of cleaning ink jet printheads without rendering the printheads inoperative by soaking the printheads in a first cleaning solution of acetone and n-methyl-2-pyrolidone, and then flushing the printhead with a gas, such as air. The solution is made of about 70% acetone and about 30% n-methyl-2-pyrolidone.

In some embodiments, prior to soaking the printhead the printhead is flushed with a second cleaning solution, such as, for example, glycol ether DPM acetate, and an operator observes the streaming of the second cleaning solution from one or more nozzles of the printhead to determine if the printhead is partially or fully plugged. The printhead can also be flushed with the second solution after being flushed with the first cleaning solution. In some instances, the printhead is discarded if the printhead remains partially or fully plugged.

In certain embodiments, a print test is performed. If the print head passes the print test, it is typically returned to service. If not, then steps are taken to determine if the failure is due to an electrical malfunction. If the failure is attributable to an electrical malfunction, the printhead is disassembled to determine the cause of the electrical malfunction. If an electrical malfunction is not the cause of the failure of the print test, then the print head is again soaked in the first cleaning solution, and then flushed with air. If the print head still fails the print test, the printhead is typically discarded.

In some embodiments, the process of soaking the printhead in the first cleaning solution and then flushing the printhead with air is performed two to three times or more. The soaking process can occur over a time period of about 15 minutes, and the flushing process can occur over a time period of about 10 seconds. The gas can be at a pressure of about 5 psi.

In another embodiment, a method of cleaning a printhead includes soaking the printhead in a solution made of acetone and n-methyl-2-pyrolidine, flushing the printheads with a air, repeating the soaking and the flushing steps two additional times, flushing the printhead with a solution of glycol ether DPM acetate, and observing the streaming of the solution of glycol ether DPM acetate from the nozzles. These steps can be followed by a print test as described above.

Embodiments may have one or more of the following advantages. Soaking the printheads in a cleaning solution of n-methyl-2-pyrolidone and acetone for a limited period of time does not cause damage to the printheads, although the cleaning solution is an aggressive chemical. In particular, the cleaning solution does not dissolve the epoxy, which holds the printheads together because the cleaning solution is able to clean out the dried ink before dissolving the epoxy. Also, since the printheads merely soak in the cleaning solution, and the air used to flush the printheads is at a low pressure, the printheads are not subjected to high internal pressures which can damage the printheads. Soaking the printheads in the cleaning solution facilitates capillary action that draws the cleaning solution up into the blocked nozzle orifices. The capillary action of the soaking process of the present invention is an effective means of rewetting and re-dissolving the pigment/polymer plugs that can cause blockage of the printheads. The yield from the cleaning process is higher than that of conventional techniques. That is, of the printheads pulled from service to be cleaned, the cleaning process is able to clean a large percentage (over 90%) of the printheads so that they can be returned to service.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1A:
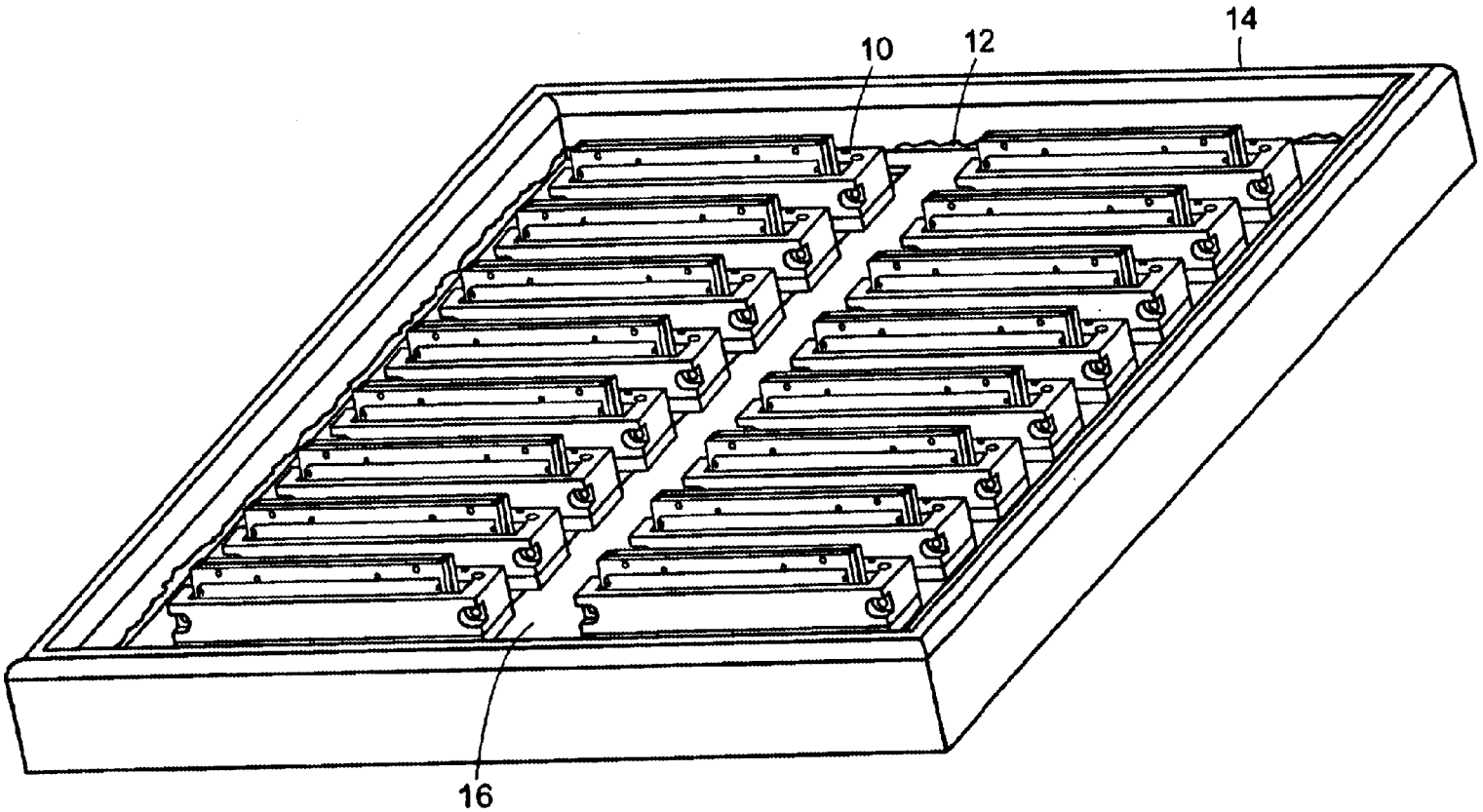
FIG. 1A is a perspective view of a series of printheads soaking in a cleaning solution within a tray in accordance with the invention.
Figure 1B:
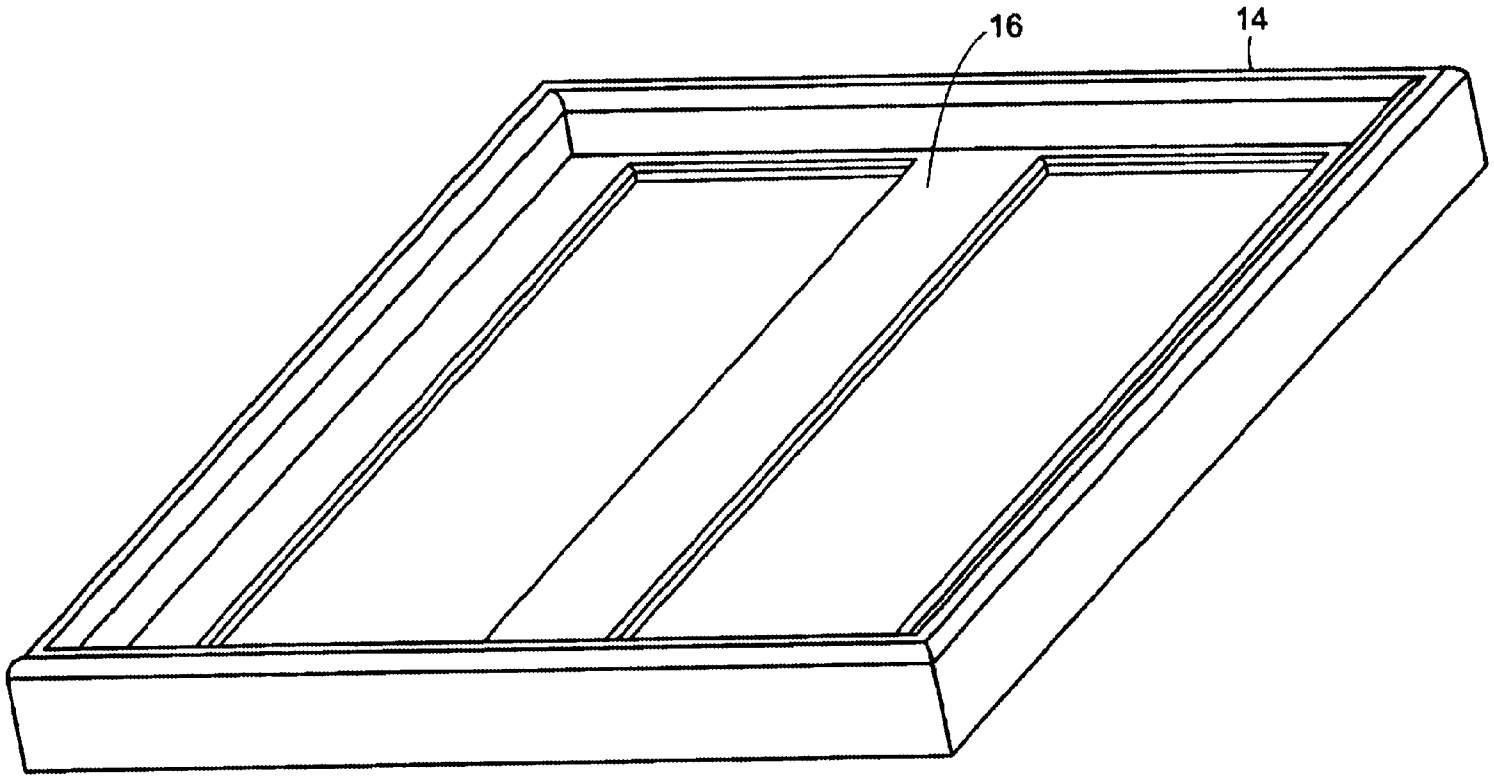
FIG. 1B is a perspective view of the tray of FIG. 1A.
Figure 2:
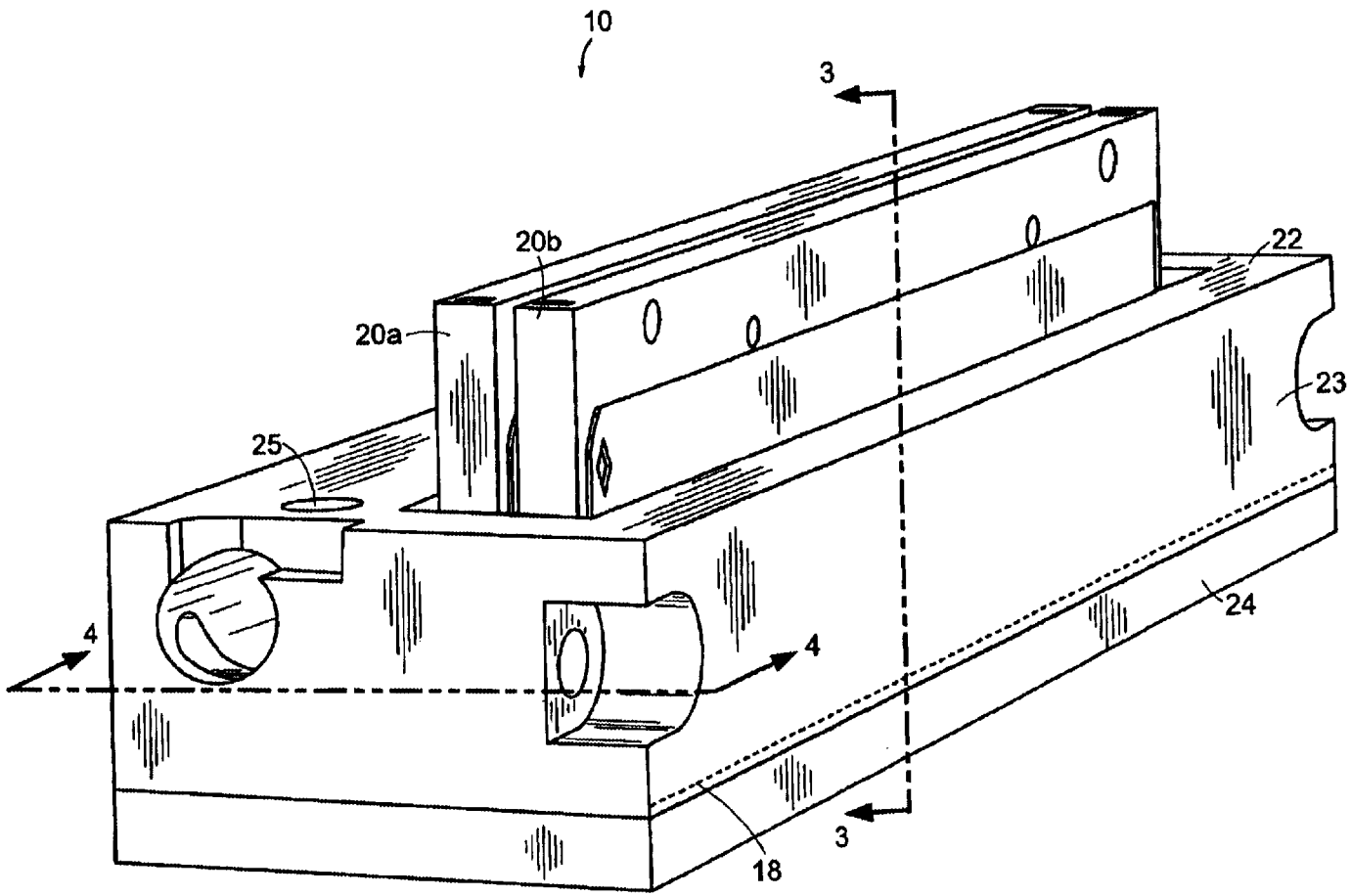
FIG. 2 is a perspective view of a single printhead of FIG. 1A.
Figure 3:
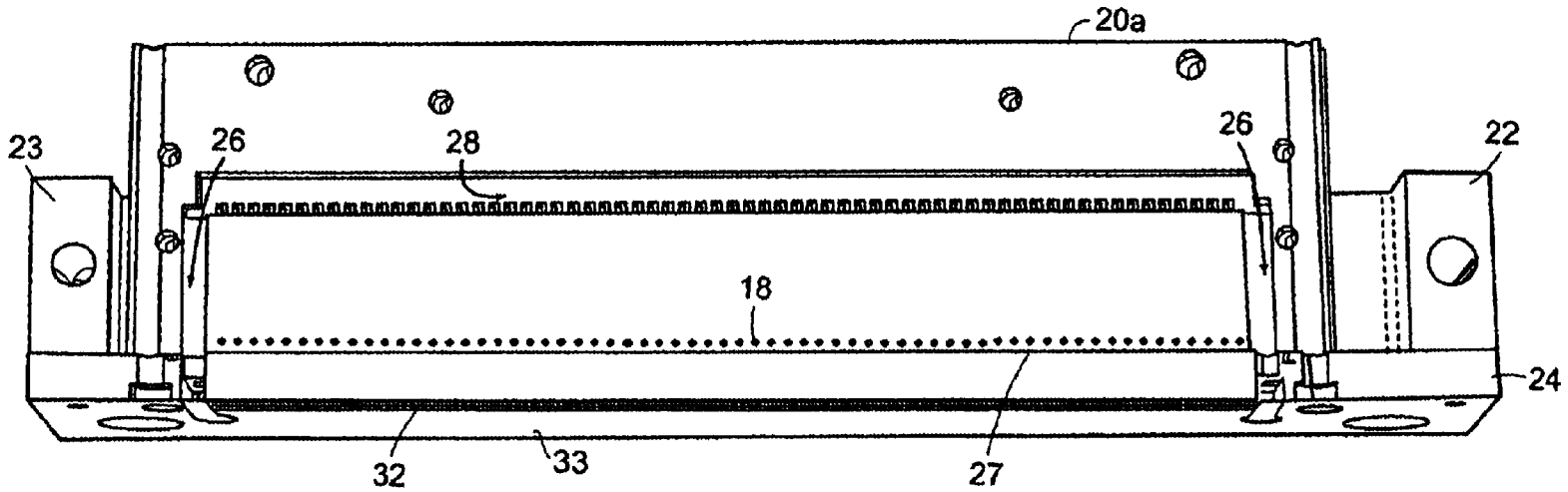
FIG. 3 is a cross-sectional view of the printhead of FIG. 2 along the line 3—3.
Figure 4:
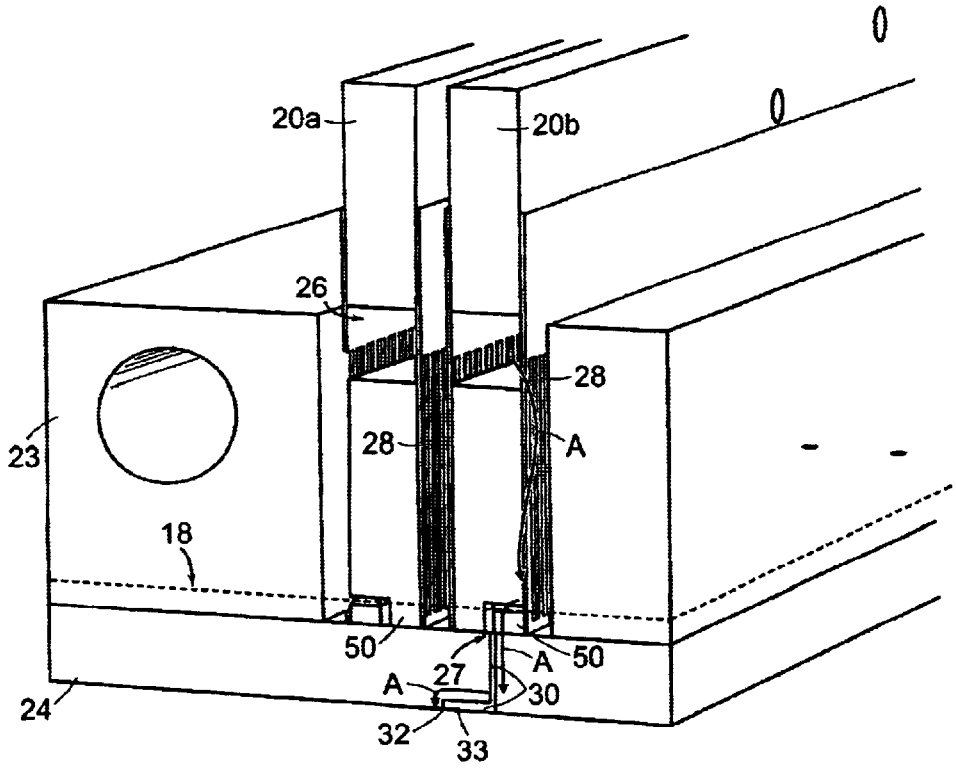
FIG. 4 is a cross-sectional view of the printhead of FIG. 2 along the line 4—4.

Referring to FIGS. 1A and 1B, there is shown a series of printheads 10 soaking in a cleaning solution 12 contained in a tray 14. The printhead 10 sits on top of a jig 16 so that the printhead 10 is immersed in the cleaning solution up to a fill-to line 18 (FIG. 2). The cleaning process of the present invention is able to remove ink that has partially or fully plugged the various channels of the printhead 10 without dissolving the epoxy which holds the printhead together, nor using a high pressure purging process, which may also break apart the printhead, to blow debris out of the printhead. The cleaning process can be used to clean out solvent-based inks and water-based inks. The cleaning process can also be used to clean out UV-curable inks if the inks have not fully cured.

The printhead 10, shown in greater detail in FIGS. 2A–2C, typifies the type of printhead used in digital drop on demand inkjet printing. Although the cleaning process is described below in conjunction with an ink jet printhead as shown in FIG. 2, the cleaning process of the present invention can be used to clean other types of printheads as well, such as, for example, those made from ceramic material or stainless steel.

The embodiment of the printhead 10 illustrated in FIGS. 2A–2B includes a pair of modules 20*a* and 20*b* press fit into a collar assembly 22. The collar assembly 22 is provided with a base 24 attached to an upper portion 23 of the collar assembly 22. A rock trap 27 is positioned between the modules 20*a* and 20*b* and the base 24. The rock trap prevents debris from flowing into the numerous channels of the base 24.

When the printhead 10 is in use, ink flows through an inlet 25 (FIG. 2) of the collar 22 into a manifold 26 of each module 20*a* and 20*b*. A set of channels 28 of each module 20*a* and 20*b* conveys the ink from the manifold 26 to another set of channels 30 of the base 24. The ink flows through the channels 30 and exit from a set of a set of nozzles 32 with orifices aligned linearly on a nozzle plate 33 through which the ink is emitted and then deposited onto a substrate. The flow of the ink through the modules is indicated by the set of arrows A.

For each module 20*a* and 20*b*, there are 128 channels 28 and a corresponding number of channels 30 in the base 24. The channels 30 and hence the nozzles 32 are interlaced so that there are 256 nozzles aligned in a linear manner. That is, as one nozzle emits ink from either module 20*a* or 20*b*, an adjacent nozzle emits ink from the other module. The printhead 10 is a type of an ink jet printhead manufactured by Spectra, Inc. of Hanover, N.H., and is described in greater detail in the product brochure entitled "Nova JA-256/80 Liquid," by Spectra, Inc., the entire contents of which are incorporated herein by reference.

Typically, the channels 30 have several right angles and have a diameter of about 100 $\mu$m, while the orifices of the nozzles 32 on the nozzle plate 33 have a diameter of about 50 $\mu$m. Over time, some of the ink accumulates in the channels 30 and the nozzles 32. For example, solvent-based inks, as well as water-based inks and UV-curable inks, contain a polymer that holds the ink in place when deposited onto a substrate. However, this polymer may build up in the various channels and nozzles and then partially or fully plug up the channels and nozzles. Embodiments of the cleaning process are able to redisolve this polymer so that it can be flushed out and the printhead 10 can be returned to service.

Figure 5A:
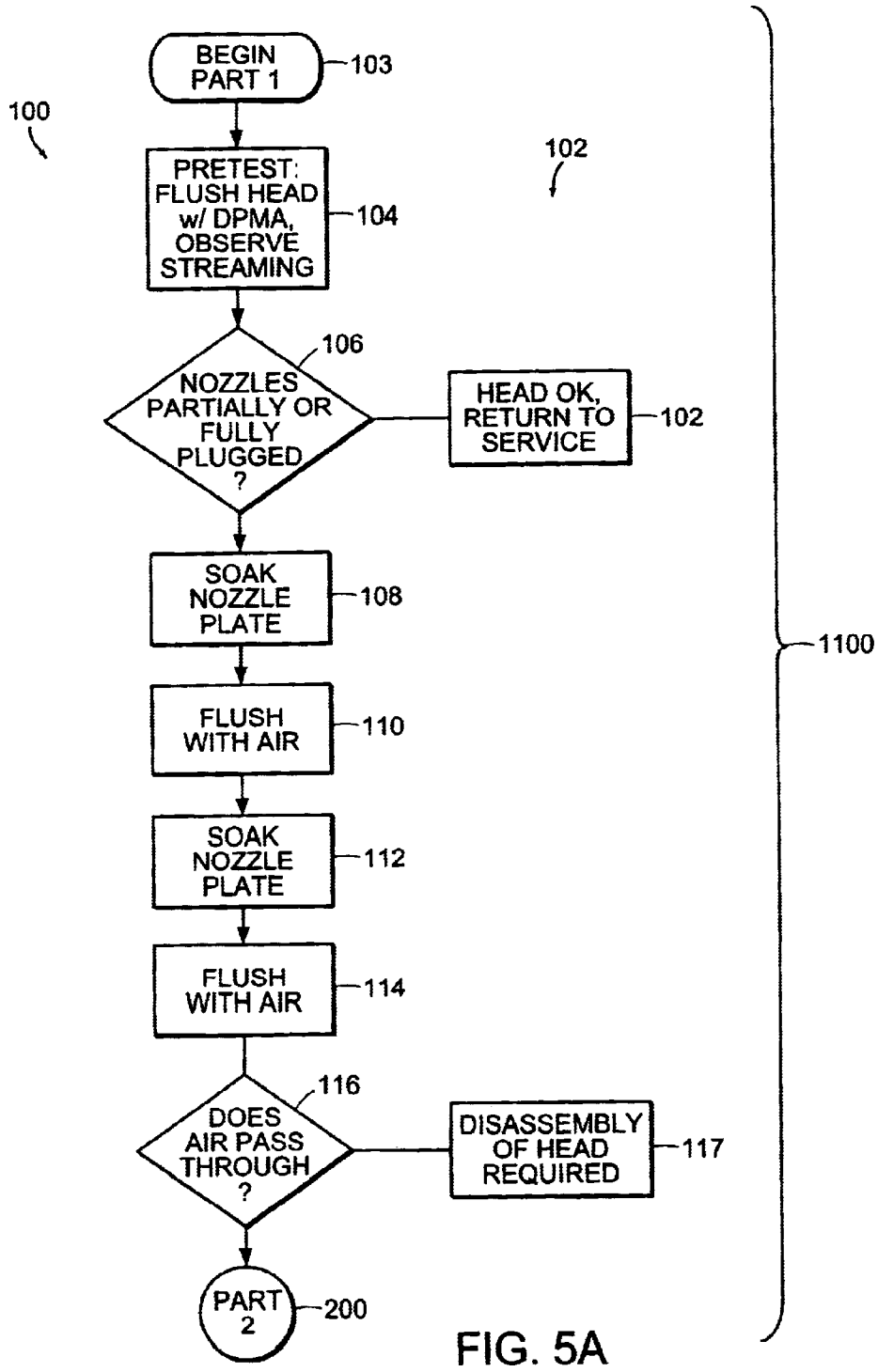
FIG. 5A is a flow diagram of step 1 of a sequence of steps for cleaning the printhead of FIG. 2 in accordance with the invention.
Figure 5B:
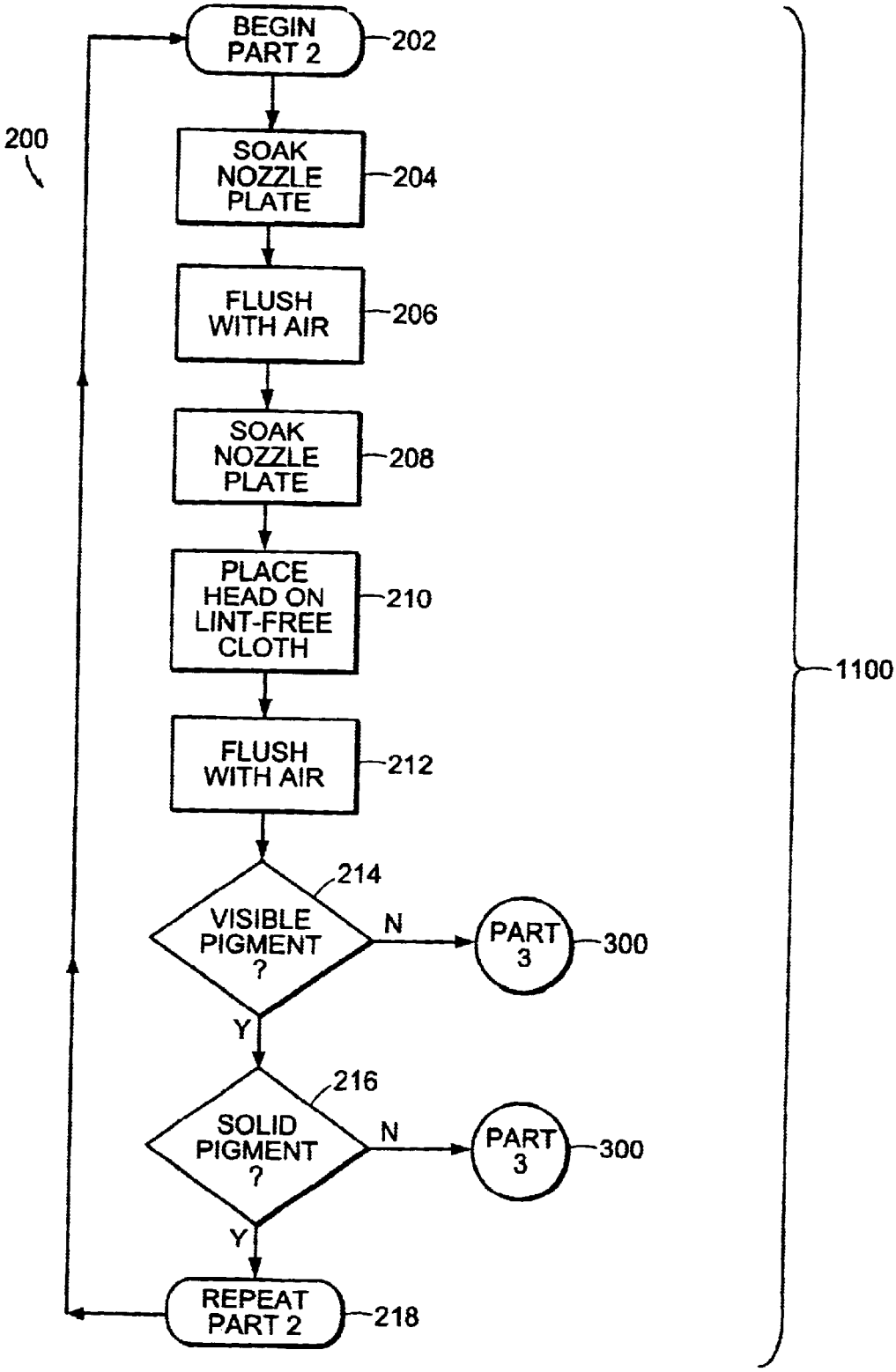
FIG. 5B is a flow diagram of step 2 of the sequence of steps for cleaning the printhead of FIG. 2.
Figure 5C:
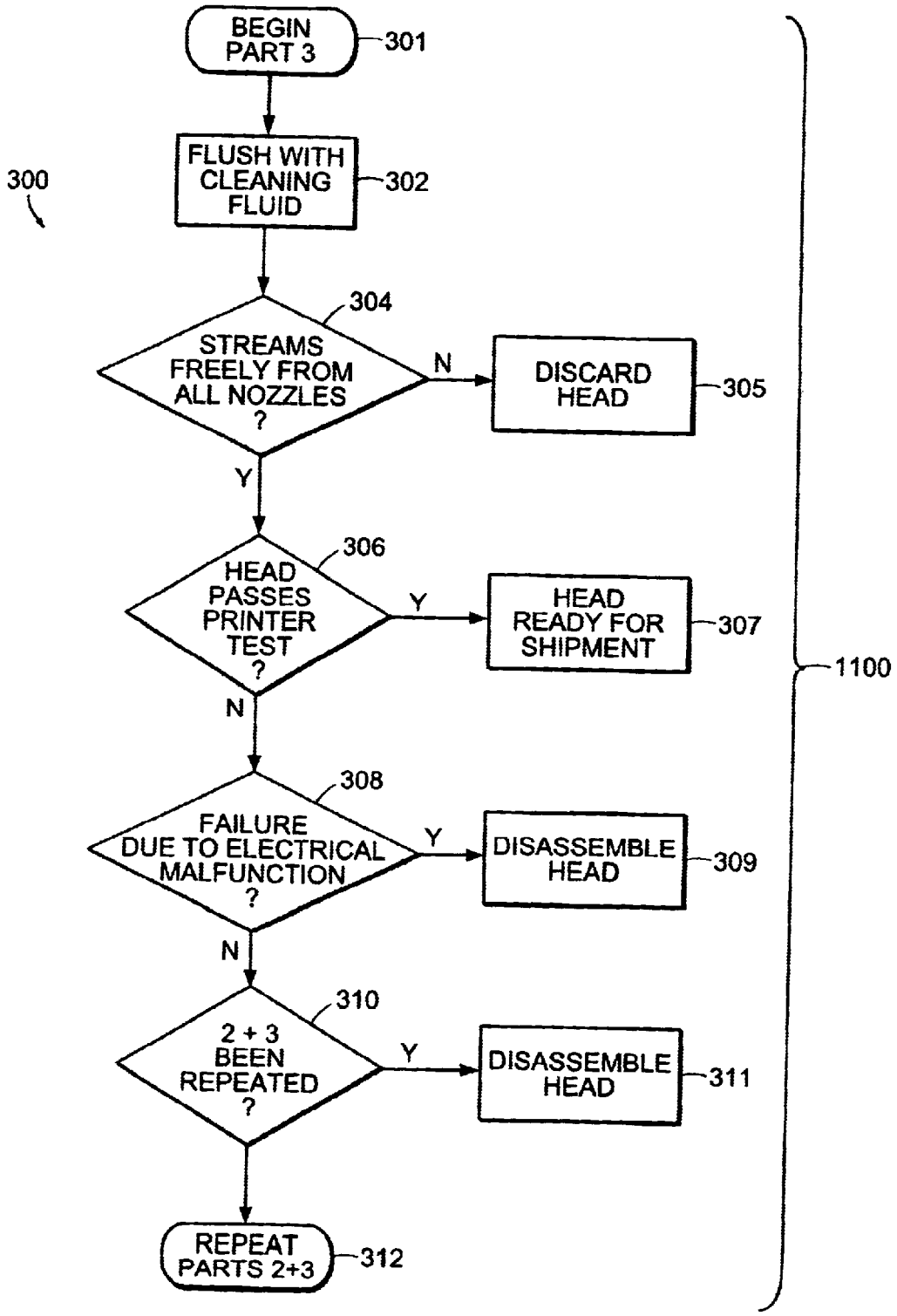
FIG. 5C is a flow diagram of step 3 of the sequence of steps for cleaning the printhead of FIG. 2.
Figure 6A:
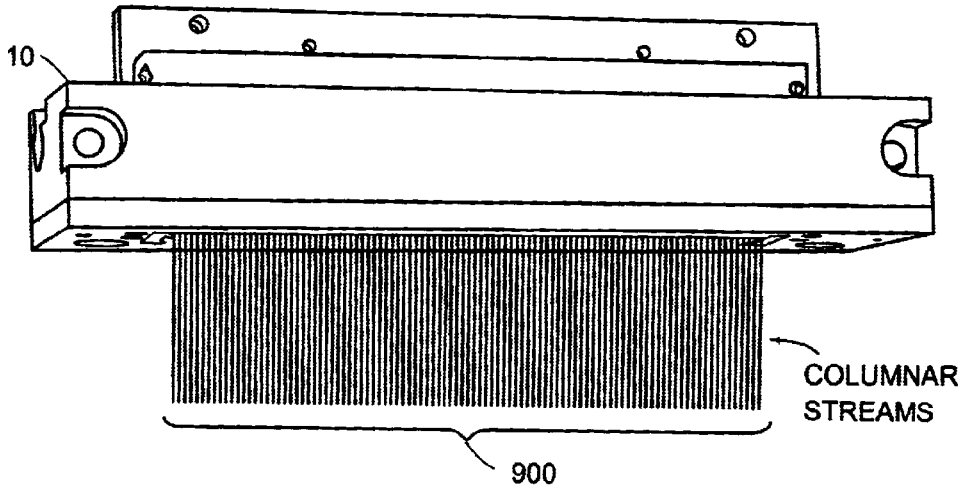
FIG. 6A illustrates how the nozzles of the printhead of FIG. 2 spray for a good stream test.
Figure 6B:
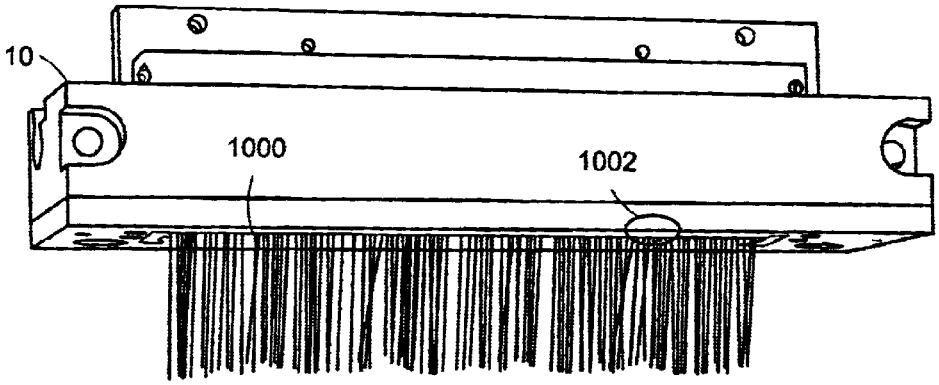
FIG. 6B illustrates how the nozzles of the printhead of FIG. 2 spray for a bad stream test.

Referring now to FIGS. 5A–5C, a process 100 for cleaning the printhead 10 will be described in accordance with the invention. After the process 100 initializes the first part 102 of the process in step 103, the process performs, in step 104, a pretest of the printhead 10. The process flushes the printhead with a solvent such as glycol ether DPM acetate under a pressure of about 5 psi, and an operator observes the streaming of the solvent of glycol ether DPM acetate through the nozzles of the printhead 10. The operator determines if the streaming of the solvent is a "good stream test," as illustrated in FIG. 6A by the columnar streams of solvent 900, or a "failed stream test," as shown in FIG. 6B. Typically, after the printhead has been in service for a period of time, the streaming of the solvent from the nozzles appears as shown in FIG. 6B, where certain nozzles 1000 are plugged, while the solvent streams from other nozzles 1002 in a ragged and uneven manner. That is, the streams are not columnar, but rather are cork screwed and/or emit from the nozzles at an angle.

If in step 106, the process 100 determines that if the printhead passes the stream test as illustrated in FIG. 6A. That is, the solvent streams are columnar. The printhead is returned to service in step 107. Otherwise, the process 100 proceeds to step 108 and soaks the printhead 10 in a solution of 70% acetone and 30% n-methyl-2-pyrolidone by weight. n-methyl-2-pyrolidone is represented by the formula $C_5H_9NO$ and the chemical structure.

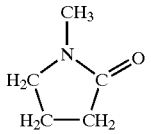

The soaking process 108 lasts about 15 minutes, and, As mentioned above, the printhead 10 is immersed in the cleaning solution up to the fill-to line 18, so that capillary action draws the cleaning solution into the nozzles 32 and up throughout the channels 30 so that the rock trap 27 as well the bottom portions 50 of the modules 20*a* and 20*b* are immersed in the cleaning solution.

Next, in step 110, the process 100 flushes the printhead 10 with a gas, such as, for example air, for about 10 seconds at a pressure of about 5 psi. Next, in step 112, the process 100 soaks the printhead 10 in the cleaning solution for another 15 minutes, and in step 114, flushes the printhead 10 again with air.

If in step 116, the process determines that air cannot pass through the printhead 10, the process labels the printhead in step 117, for example, with a red sticker, to indicate that the printhead may require disassembly to perhaps remove inorganic debris from the rock trap 27.

If air is able to pass through the printhead 10, the process 100 proceeds a second part 200 of the process 100. After initializing the second part 200 in step 202, the process 100 again soaks the printhead 10 in the cleaning solution for about 15 minutes in step 204, and then flushes the printhead with air in step 206 for about 10 seconds. In step 208, the process soaks the printhead again in the cleaning solution. The process in step 210 places the head on a lint-free cloth for example, and then in step 212 flushes the printhead with air for 10 seconds at 5 psi. If the process in step 214 determines that no visible pigment is emitted from the printhead 10, the process marks the printhead 10 with a blue sticker, for example, and proceeds to a third part 300 of the process 100. If the pigment is visible, the process determines in step 216 if the pigment is solid or not. If the pigment is not solid, the process marks the printhead with a green sticker, and proceeds to the third part of the process 300. If the pigment is solid, in step 218 the process 100 marks the printhead with a yellow sticker and repeats the second part of the process 200 one additional time.

Part 3 of the process 300 is essentially a testing test. The third part begins in step 301, and then the process 100 flushes the printhead with a cleaning fluid such as glycol ether DPM acetate in step 302. Again, an operator observes how the cleaning fluid streams from the printhead in step 304. It the solvent streams as that shown in FIG. 6B (failed stream test), the process 100 in step 305 discards the printhead since the printhead is essentially unrecoverable.

If the printhead passes the stream test, then in step 306, the process checks the printing capabilities in a print test. If the printhead passes the print test, then the process 100 readies the printhead to be returned to service in step 307.

If the printhead fails the print test, the process 100 determines in step 308 if the failure is due to an electrical malfunction, and if it is, then the operator dissassembles the printhead in step 309 to repair the printhead.

If the printhead print failure is not attributable to an electrical malfunction, then the process 100 determines in step 310 if parts 2 and 3 of the cleaning process have been repeated for that particular printhead. If those parts have been repeated, then the operator disassembles the printhead in step 311 to determine the cause of the print test failure. For example, the failure may be due to debris accumulated on the rock trap, in which case, the operator merely has to remove the debris from the trap. Otherwise parts 2 and 3 of the cleaning process are repeated once more as indicated by step 312.

Figure 7A:
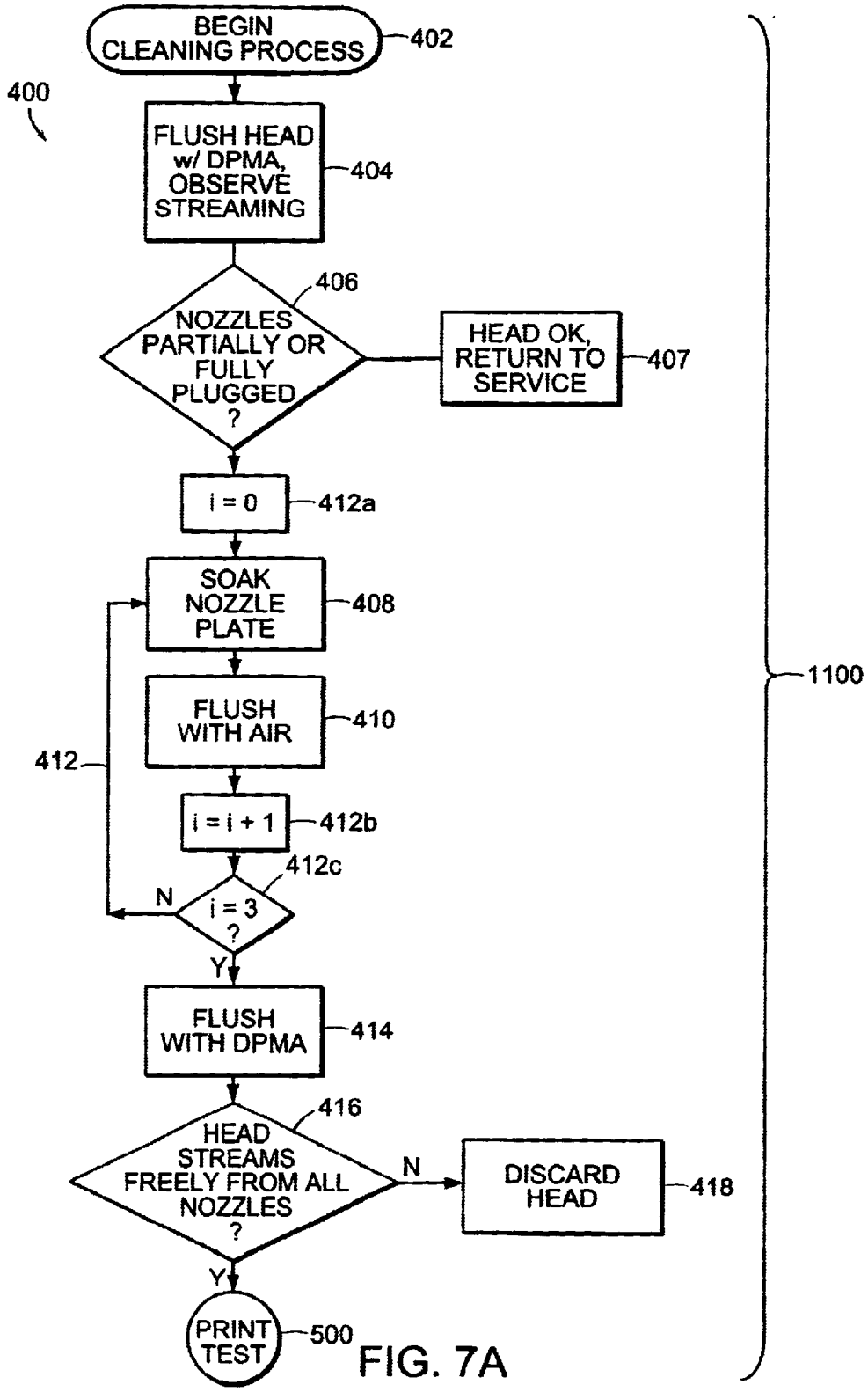
FIG. 7A is a flow diagram of an alternative sequence of steps for cleaning the printhead of FIG. 2.
Figure 7B:
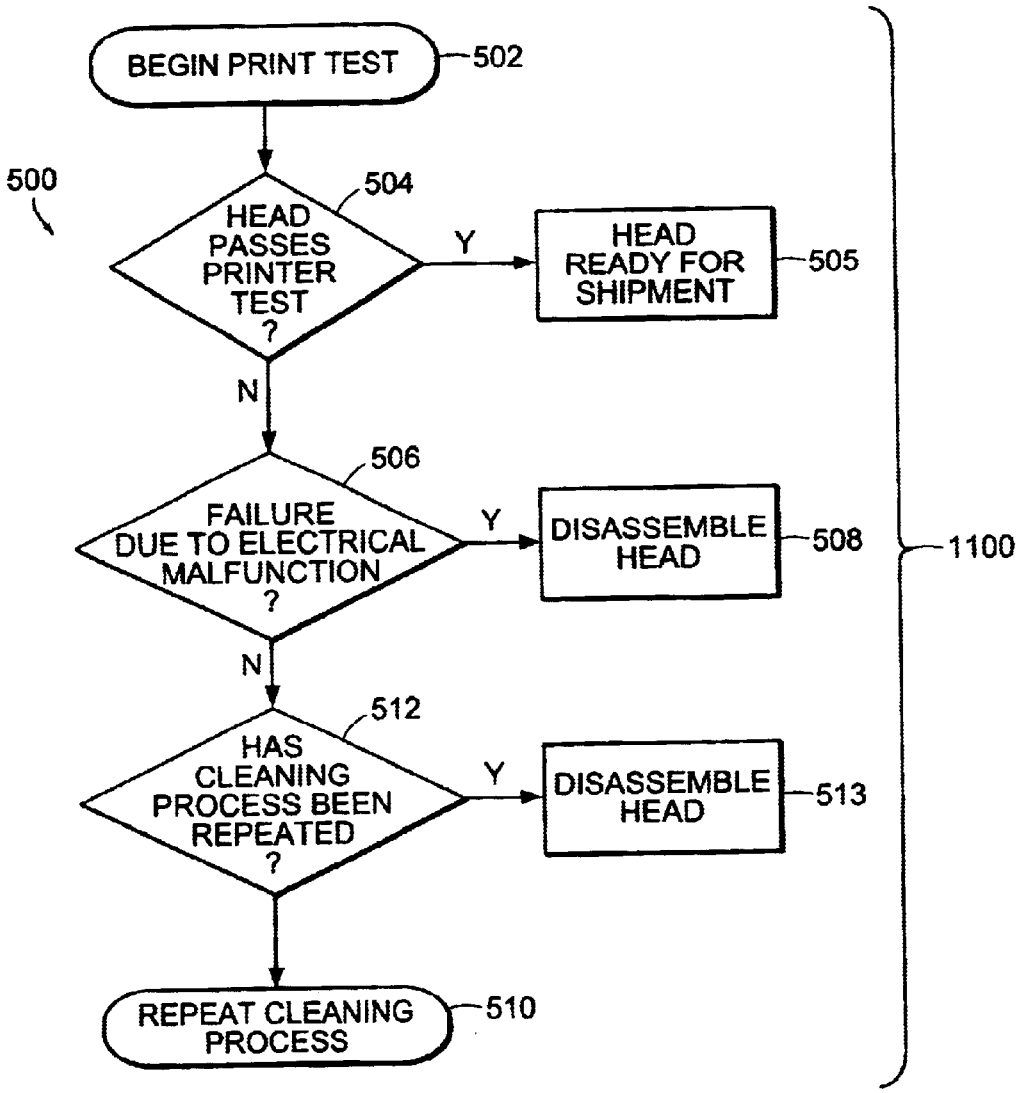
FIG. 7B is a flow diagram of a sequence of steps for a print test.

The cleaning process is not limited to that shown in FIGS. 5A–5C. For example, there is shown in FIG. 7A an alternative process 400 with a shortened sequence of steps to clean the printhead 10. The cleaning process 400 beings in step 402 and proceeds to step 404 where the process 400 flushes the printhead and determines whether or not the printhead passes the streaming test. Thus in step 406, if the process 400 determines the printhead is not partially or fully plugged, the process returns the printheads to service in step 407. If the printhead is partially or fully plugged, then in step 408 the process soaks the printhead in a solution of 30% n-methyl-2-pyrolidone and 70% acetone for about 15 minutes, and then in step 410 flushes the printhead with air at about 5 psi for about 10 seconds. This soak/flush sequence of steps is performed one or more times. In the illustrated embodiment, the sequence is repeated three times as indicated by the logic loop 412. That is prior to the first soak/flush sequence, the counter i is initialized to zero in step 412*a*. Then, after each soak/flush sequence, the counter i is incremented by one in step 412*b*, and when the process 400 determines in step 412*c* that i=3, the process proceeds to step 414.

In step 414, the process 400 flushes the printhead with glycol ether DPM acetate, and determines in step 416 if the printheads stream freely (FIG. 6A) or not (FIG. 6B). If they do not, then the process 400 discards the printhead in step 418. Otherwise the process proceeds to a print test 500 which begins in step 502. Next, in step 504, the process determines if the printhead passes the print test. If it does, the process prepares the printhead for shipment back to service in step 505. Otherwise in step 506, the process evaluates the printhead 10 to determine if the print failure was attributable to an electrical malfunction. If it is, then the process dissassembles the printhead in step 508 for repair. If the failure is not due to an electrical malfunction, then the process 400 cleans the printhead one more time as indicated by step 510. If the cleaning process has been repeated once as determined in step 512, then the process 400 has the printhead disassembled for repair in step 513.

The cleaning processes 100 and 400 can be manual operations. In such cases, a human operator performs each of the above identified and discussed steps. However, in some applications, the processes 100 and 400 are partially automated with some manual intervention, for example, to observe the streaming of the printheads. In such cases, the automated steps of the processes 100 and 400 are under the direction of a controller 1100. In other applications, the processes 100 and 400 are fully automated with essentially no human intervention, in which case all the steps of the processes 100 and 400 are under the direction of the controller 1100.

It will be apparent to those of ordinary skill in the art that methods disclosed herein may be embodied in a computer program product that includes a computer usable medium. For example, such a computer usable medium can include a readable memory device, such as a hard drive device, a CD-ROM, a DVD-ROM, or a computer diskette, having computer readable program code segments stored thereon. The computer readable medium can also include a communications or transmission medium, such as a bus or a communications link, either optical, wired, or wireless, having program code segments carried thereon as digital or analog data signals.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method of cleaning ink jet printhead, comprising the steps of:

first soaking the printhead in a solution of acetone and n-methyl-2-pyrolidone; and then flushing the printhead with a gas.

2. The method of claim 1, wherein the solution is made of about 70% acetone and about 30% n-methyl-2-pyrolidone by weight.

3. The method of claim 1, wherein the gas is air.

4. The method of claim 1, further comprising the step of, prior to soaking the printhead, flushing the printhead with a second cleaning solution, and then observing the streaming of the second cleaning solution from one or more nozzles of the printhead to determine if the printhead is partially or fully plugged.

5. The method of claim 1, wherein after flushing the printhead with a gas, flushing the printhead with a second cleaning solution, and observing the streaming of the second cleaning solution from one or more nozzles of the printhead to determine if the printhead is partially or fully plugged.

6. The method of claim 1 further comprising repeating the soaking of the printhead with a solution of acetone and n-methyl-2-pyrolidone and the flushing of the printhead with a gas.

7. The method of claim 1 wherein the soaking with a solution of acetone and n-methyl-2-pyrolidone and the flushing with a gas are repeated twice.

8. The method of claim 1 wherein the soaking occurs over a time period of about 15 minutes.

9. The method of claim 1 wherein the flushing occurs over a time period of about 10 seconds.

10. The method of claim 1 wherein the gas during the flushing is at a pressure of about 5 psi.

11. The method of claim 4, wherein the second cleaning solution is glycol ether DPM acetate.

12. The method of claim 5, wherein the second cleaning solution is glycol ether DPM acetate.

13. The method of claim 5 further comprising discarding the printhead if the printhead is partially or fully plugged.

14. The method of claim 5 further comprising performing a print test of the printhead.

15. The method of claim 14 further comprising returning the printhead to service if the printhead passes the print test.

16. The method of claim 14, wherein if the printhead fails the print test, determining if the failure is attributable to an electrical malfunction.

17. The method of claim 16 further comprising disassembling the printhead if the failure is due to an electrical malfunction.

18. The method of claim 16 further comprising repeating the soaking with a solution of acetone and n-methyl-2-pyrolidone and the flushing of the printhead with a gas if the failure is not attributable to an electrical malfunction.

19. The method of claim 18 further comprising disassembling the printhead if the soaking and the flushing has been repeated once.

20. A method of cleaning an ink jet printhead, comprising:

soaking the printhead in a solution made of acetone and n-methyl-2-pyrolidone;

flushing the printhead with air;

repeating the soaking and the flushing steps two additional times;

flushing the printhead with a solution of glycol ether DPM acetate; and observing the streaming of the solution of glycol ether DPM acetate from one or more nozzles of the printhead.

21. The method of claim 20, wherein if the solution of the glycol ether DPM acetate streams freely from the nozzles, performing a print test on the printhead.

22. The method of claim 20 further comprising discarding the printhead if the solution of glycol ether DPM acetate does not stream freely from the one or more nozzles of the printhead.

23. The method of claim 20 wherein the soaking occurs over a time period of about 15 minutes.

24. The method of claim 20 wherein the flushing occurs over a time period of about 10 seconds.

25. The method of claim 20 wherein the air during the flushing is at a pressure of about 5 psi.

26. The method of claim 21 further comprising returning the printhead to service if the printhead passes the print test.

27. The method of claim 21, wherein if the printhead fails the print test, further comprising determining if the failure is due to an electrical malfunction.

28. The method of claim 27 further comprising disassembling the printhead to repair the printhead if the failure is due to the electrical malfunction.

29. The method of claim 27 further comprising repeating the soaking of the printhead with a solution of acetone and n-methyl-2-pyrolidone and the flushing of the printhead with a gas if the failure is not due to the electrical malfunction.

30. The method of claim 29 further comprising disassembling the printhead if the soaking with a solution of acetone and n-methyl-2-pyrolidone and the flushing of the printhead with a gas has been repeated once.

* * * * *